US012616351B1

(12) United States Patent
Melilli Otte

(10) Patent No.: US 12,616,351 B1
(45) Date of Patent: May 5, 2026

(54) STEEL WOOL CADDY APPARATUS, AND A METHOD OF MAKING, AND USING SAME

(71) Applicant: Maria E. Melilli Otte, Poughkeepsie, NY (US)

(72) Inventor: Maria E. Melilli Otte, Poughkeepsie, NY (US)

( * ) Notice: Subject to any disclaimer, the term of this patent is extended or adjusted under 35 U.S.C. 154(b) by 0 days.

(21) Appl. No.: 19/182,511

(22) Filed: Apr. 17, 2025

(51) Int. Cl.
*A47L 13/51* (2006.01)
*A47L 13/04* (2006.01)

(52) U.S. Cl.
CPC ..... *A47L 13/51* (2013.01); *A47L 13/04* (2013.01)

(58) Field of Classification Search
CPC .. A47K 5/04; A47K 5/02; A47L 13/04; A47L 13/51
USPC ..... 312/351; 248/176, 31–176.3; D6/532, D6/526, 553, 525
See application file for complete search history.

(56) References Cited

U.S. PATENT DOCUMENTS 1,620,903 A 3/1927 Lance
2,037,944 A 4/1936 Steinhardt
3,164,356 A * 1/1965 Zajaczkowski ..... A47K 5/05 248/688
4,993,546 A * 2/1991 Southard ..... A47K 1/08 D6/532
D668,496 S 10/2012 Ho et al.
2007/0056862 A1* 3/2007 Jones ..... A47K 5/04 206/77.1

FOREIGN PATENT DOCUMENTS

DE 202011003091 U1 * 7/2011 ..... A47L 13/51
DE 202011000877 U1 * 10/2011 ..... A47K 5/03
KR 200377532 Y1 * 3/2005 ..... A47K 5/02

OTHER PUBLICATIONS

Translation of DE202011003091U1 (Year: 2011).*
Translation of DE202011000877U1 (Year: 2011).*
Translation of KR200377532y1 (Year: 2003).*

* cited by examiner

*Primary Examiner* — Tom Rodgers
(74) *Attorney, Agent, or Firm* — Aziz M. Ahsan; AHSAN & ASSOCIATES, PLLC

(57) ABSTRACT

The present invention relates generally to a content holding apparatus and a method of using same. More particularly, the invention encompasses a steel wool caddy apparatus, and a method of making, and using same. The invention also provides several embodiments of the inventive steel wool caddy apparatus and a method of using same. The invention provides at least one standoff to keep the steel wool or pad above the surface using the least amount of stand-off surface area to dry, and to extend the life of the steel wool or pad. The inventive steel wool caddy apparatus could be used to hold a pad, a steel wool, a steel wool pad, a cleaning pad, a bar soap, a sponge, to name a few.

13 Claims, 1 Drawing Sheet

STEEL WOOL CADDY APPARATUS, AND A METHOD OF MAKING, AND USING SAME

FIELD OF THE INVENTION

The present invention relates generally to a content holding apparatus and a method of using same. More particularly, the invention encompasses a steel wool caddy apparatus, and a method of making, and using same. The invention also provides several embodiments of the inventive steel wool caddy apparatus and a method of using same. The invention provides at least one standoff to keep the steel wool or pad above the surface using the least amount of stand-off surface area to dry, and to extend the life of the steel wool or pad. The inventive steel wool caddy apparatus could be used to hold a pad, a steel wool, a steel wool pad, a cleaning pad, a bar soap, a sponge, to name a few.

BACKGROUND INFORMATION

Content holding apparatuses have been used in the industry for a variety of reasons, and they come in many shapes, sizes, and other physical features and attributes.

U.S. Pat. No. 1,620,903 (B. G. Lance), the entire disclosure of which is incorporated herein by reference, discloses a steel wool holder.

U.S. Pat. No. 2,037,944 (A. Steinhardt), the entire disclosure of which is incorporated herein by reference, discloses a scouring pad and holder thereof.

U.S. Design Pat. No. D668,496 (Hsin Kun Ho, et al.), the entire disclosure of which is incorporated herein by reference, discloses a scouring pad holder.

This invention improves on the deficiencies of the prior art and provides an inventive steel wool caddy apparatus, and a method of making, and using same.

PURPOSES AND SUMMARY OF THE INVENTION

The invention is a novel steel wool caddy apparatus, and a method of making, and using same.

Therefore, one purpose of this invention is to provide a steel wool caddy apparatus that is easy to use.

Another purpose of this invention is to provide a steel wool caddy apparatus and a method of using same, where the steel wool can be placed and removed on the upper surface of the inventive caddy.

Yet another purpose of this invention is to provide a steel wool caddy apparatus and a method of using same where the caddy has several unique features that help the environment from wastage and rust deterioration.

Another purpose of this invention is to minimize steel wool rust and to extend the life of an average steel wool pad.

Still yet another purpose of this invention is to provide a variety of embodiments of this inventive steel wool pad caddy.

Therefore, in one aspect this invention comprises a content holding apparatus, comprising;

(a) a base having an upper surface, a lower surface, and at least three side wall surface, wherein said at least three side wall surfaces are connected and between said upper surface, and said lower surface to form said base;

(b) at least one stand-off having a first end, and a second end, and wherein said first end is secured onto said upper surface of said base; and (c) at least one steel wool holding surface at said second end of said at least one stand-off.

DETAILED DESCRIPTION

Figure 1:
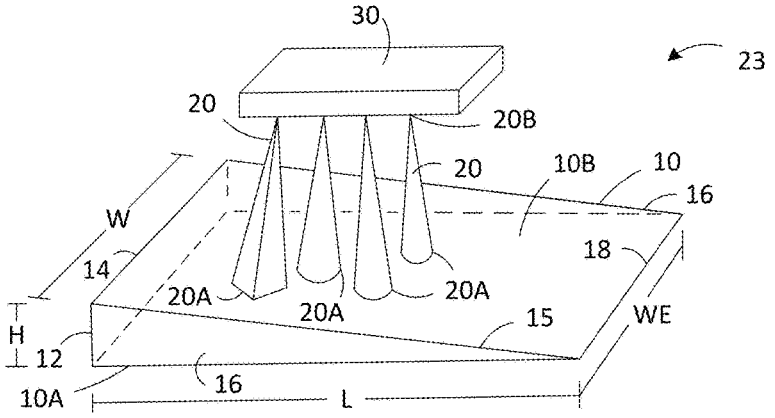
FIG. 1, illustrates a side perspective view of an inventive steel wool caddy apparatus, according to a first embodiment of this invention.

The inventive steel wool caddy apparatus, and a method of making, and using same. will now be discussed with reference to FIGS. 1 through 5. Although the scope of the present invention is much broader than any particular embodiment, a detailed description of the preferred embodiment follows together with drawings. These drawings are for illustration purposes only and are not drawn to scale. Like numbers represent like features and components in the drawings.

FIG. 1, illustrates a side perspective view of an inventive steel wool caddy apparatus 23, according to a first embodiment of this invention. The inventive steel wool caddy apparatus 23, has a base 10, having a first or lower or bottom surface 10A, a second or upper or top surface 10B, which is connected to a vertical wall 12, having a height H, a back wall 14, having a width W, a side wall 16, having a length L, and a front edge 18, having a front edge width WE. For some applications the base 10, could be approximately about 3 inches wide at the top or first end 14, and then tapering to approximately about 1.5 inches at the second or bottom or the opposite end 18. The height H, of this exemplary inventive steel wool caddy is approximately about 2 inches tall at the top graduating down to flush to the surface at the second or bottom or front edge 18, so that the front edge end 18, can overhang slightly into a sink (not shown), allowing the water to drain from the upper surface 10B, into the sink. The side wall length L could be approximately about 4 inches long. Projecting from the inside of the base 10, and on the upper surface 10B, are at least spikes, or standoffs 20, which will be sized to be parallel to the surface of the sink, so that a steel wool 30, or a steel wool pad 30, or a cleaning pad 30, can sit squarely on top of the spikes or standoff 20, allowing as much air circulation as possible, and as little contact with any surface that might allow water to accumulate, and rust to develop as a result. It is preferred that at least a portion of the upper surface or the top surface 10B, of the inventive steel wool caddy base 10, has a slope 15, or a reclining slope 15, so as to channel the water (not shown) to slide or drain along the upper surface 10B, and into a sink (not shown). As one can see in FIG. 1, that the stand-offs 20, for the purposes of illustration are of a cylindrical shape 20, having a standoff base 20A, and a standoff end 20B. For some applications the standoff base 20A, could have a shape selected from a group comprising, a triangular base 20A, a rectangular base 20A, a polygonal base 20A, a circular base 20A, an elliptical base 20A, and combinations thereof, to name a few. For some applications the standoff end 20B, could graduate to a point 20B, to create a smallest or a least surface area 20B. This type of standoff 20, could also be referred to as a spike standoff 20, or a spike-shaped standoff 20. It should be further appreciated that the standoffs 20, provides the support to the steel wool or pad 30, with a minimum of surface contact with the standoffs 20, as the standoffs 20, end with a point surface contact 20B. For some applications the standoffs 20, with a minimum surface contact 20B, could be a preferred standoff 20. It has been discovered that the minimum surface contact 20B, provided by the standoffs 20, reduces the rusting or deterioration of the steel wool or pad 30, while also allowing for more surrounding air to quickly dry the steel wool or pad 30, after use, including surface stability between use, as it is easier to pick-up the steel wool or pad 30, from a pointed or spiked surface 20B. For the purposes of illustration, the steel wool 30, steel wool pad 30, cleaning pad 30, have been used, but for some applications one could also use a bar soap 30, a sponge 30, to name a few. It has been discovered that the bar soap 30, will last longer when used with the inventive steel wool caddy apparatus 23, and will also leave very little soap scum. Similarly, the sponge 30, will last longer when used with this inventive steel wool caddy apparatus 23, as it has been discovered that it will have less bacteria when the sponge 30, is dry, as the standoffs 20, having limited contact surface 20 B, will help in the sponge 30, drying process.

Figure 2:
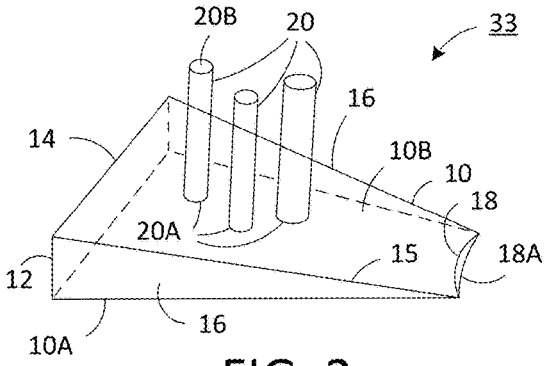
FIG. 2, illustrates a side perspective view of an inventive steel wool caddy apparatus, according to a second embodiment of this invention.

FIG. 2, illustrates a side perspective view of an inventive steel wool caddy apparatus 33, according to a second embodiment of this invention. The inventive steel wool caddy apparatus 33, is similar to the inventive steel wool caddy apparatus 23, except that it has three spikes or standoffs 20, and that the back wall 14, having a width W, has a wider width than the front edge 18, having a front edge width WE. Additionally, the front edge 18, has a curvature 18A. The curvature 18A, could be a concave curvature 18A, or a convex curvature 18A. Furthermore, as one can appreciate that the standoff end 20B, have a substantially flat surface 20B.

Figure 3:
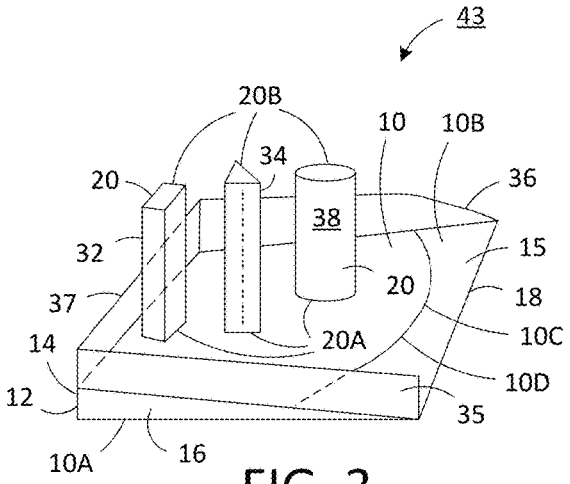
FIG. 3, illustrates a side perspective view of an inventive steel wool caddy apparatus, according to a third embodiment of this invention.

FIG. 3, illustrates a side perspective view of an inventive steel wool caddy apparatus 43, according to a third embodiment of this invention. The inventive steel wool caddy apparatus 43, is similar to the inventive steel wool caddy apparatus 23, except that it has a plurality of spikes or standoffs 20, that have a variety of shapes, such as, for example, a rectangular shape 32, a triangular shape 34, an ovel shape 38, to name a few. For some applications the inventive steel wool caddy base 10, could have retaining wall, such as, a straight edge retaining wall 35, a curved retaining wall 36, to channel the water (not shown) to slide or drain along the upper surface 10B, and into a sink. For some applications the straight edge retaining wall 35, and the curved retaining wall 36, could be joined or connected via at least one back or rear retaining wall 37. For some applications the base 10B, or the upper surface 10B, could have a flat base surface 10B, or a concave shaped base surface 10C, or an undulating base surface 10D, or an outwardly reclining base surface 10B.

Figure 4:
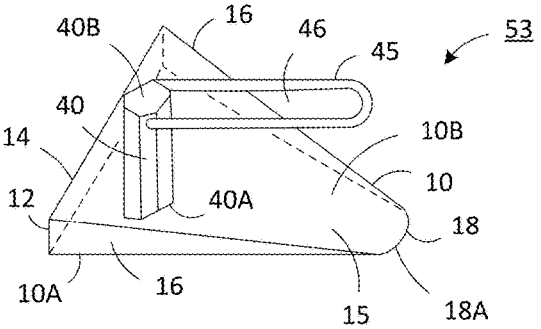
FIG. 4, illustrates a side perspective view of an inventive steel wool caddy apparatus, according to a fourth embodiment of this invention.

FIG. 4, illustrates a side perspective view of an inventive steel wool caddy apparatus 53, according to a fourth embodiment of this invention. The inventive steel wool caddy apparatus 53, is similar to the inventive steel wool caddy apparatus 23, except that it has at least one spike or standoff 40, and that the back wall 14, having a width W, is wider than the front edge 18, having a front edge width WE. Additionally, the front edge width WE, is curved, between the two sidewalls 16, and creating a curvature 18A. The at least one spike or standoff 40, has a polygonal shape 40, and has an first or lower surface 40A, which is attached to the upper surface 10B, of the base 10, and a second or upper surface 40B. The second or upper surface 40B, has secured thereto at least one U-Shaped steel wool holder 45, and has a central opening 46. A user would place at least one steel wool or pad 30, at the top surface of the at least one U-Shaped steel wool holder 45, to allow the steel wool or pad 30, to allow air to naturally dry it after use.

Figure 5:
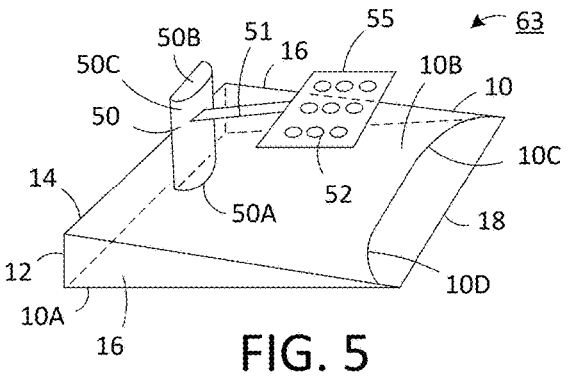
FIG. 5, illustrates a side perspective view of an inventive steel wool caddy apparatus, according to a fifth embodiment of this invention.

FIG. 5, illustrates a side perspective view of an inventive steel wool caddy apparatus 63, according to a fifth embodiment of this invention. The inventive steel wool caddy apparatus 63, is similar to the inventive steel wool caddy apparatus 23, except that it has at least one spike or standoff 50. The at least one spike or standoff 50, has a semicircular or semi-oval shape 50, and has a first or lower surface 50A, which is attached to the upper surface 10B, of the base 10, and a second or upper surface 50B, and a wall surface 50C. Along the wall surface 50C, and secured thereto is at least one paddle shaped steel wool holder 55, and having at least one extension or arm 51, having a plurality of holes or openings 52. A user would place at least one steel wool or pad 30, onto the top surface of the at least one paddle shaped steel wool holder 55, so as to allow the steel wool or pad 30, to naturally dry by the air after use.

As one can appreciate that one of the purposes of this inventive steel wool caddy design is to minimize steel wool rust, and to extend the length of the life of the average steel wool or pad 30, and one of the ways this is done is my minimizing the surface contact of the steel wool or pad 30, with another surface, and to allow the surrounding air to naturally air dry the steel wool or pad 30, or the steel wool pad 30.

The cross-sectional shape for the inventive steel wool caddy spike or standoff 20, 40, 50, can be selected from a group comprising a triangle shape, a square shape, a rectangular shape, a circular shape, a semicircular shape, an oval shape, a polygonal shape, a cylindrical shape, a cylindrical shape graduating to a point, a spike shape, and combinations thereof, to name a few.

It should also be appreciated that the inventive steel wool caddy spike or standoff 20, 40, 50, can be selected from a group comprising a triangle shape, a square shape, a rectangular shape, a circular shape, a semicircular shape, an oval shape, a polygonal shape, a cylindrical shape, and combinations thereof, to name a few, where the standoff end 20B, that comes in contact with the steel wool or pad 30, graduates to a point 20B, or a smaller surface area 20B.

For the purposes of illustration the materials used to make this inventive steel wool caddy 23, 33, 43, 53, 63, can be any non-porous material. However, for some applications the at least one material for the inventive steel wool caddy 23, 33, 43, 53, 63, can be selected from a group comprising non-porous material, metal, aluminum, stainless steel, plastic, silicon, rubber, polymeric material, composite material, wood, and combinations thereof, to name a few.

The shape of the inventive steel wool caddy base 10, could be selected from a group comprising of a triangular shape, a rectangular shape, a square shape, a wedge shape, a curved shape, a circular shape, and combinations thereof, to name a few.

The shape of the inventive steel wool caddy base or upper surface 10B, could be selected from a group comprising of a flat surface, a concave surface, an undulating surface, an outwardly reclining surface, and combinations thereof, to name a few.

The pad 30, could be selected from a group comprising a steel wool, a steel wool pad, a cleaning pad, a bar soap, a sponge, and combinations thereof, to name a few.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

It should be further understood that throughout the specification and claims several terms have been used and they take the meanings explicitly associated herein, unless the context clearly dictates otherwise. For example, the phrase "in one embodiment" as used herein does not necessarily refer to the same embodiment, though it may. Additionally, the phrase "in another embodiment" as used herein does not necessarily refer to a different embodiment, although it may. Thus, various embodiments of the invention may be readily combined, without departing from the scope or spirit of the invention.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A content holding apparatus, comprising;

(a) a base having an upper surface, a lower surface, and at least three side wall surface, wherein said at least three side wall surfaces are connected and between said upper surface, and said lower surface to form said base, and wherein said upper surface has a downward slope creating a high end, and a drain end, and wherein said lower surface has a substantially planar surface;

(b) at least one stand-off having a first end, and a second end, and wherein said first end of said at least one stand-off is secured to said upper surface having said downward slope of said base;

(c) at least one horizontal structure is secured to an outer surface of said second end of said at least one stand off such that said at least one horizontal structure secured to said outer surface of said at least one stand-off is substantially parallel to said lower surface having said substantially planar surface of said base;

(d) wherein said at least one horizontal structure creates a substantially parallel upper surface to hold at least one content parallel to said lower surface having said substantially planar surface of said base; and (e) wherein said base is unitary connected to said at least one stand-off, and said at least one stand-off is unitary connected to said at least one horizontal structure to form a single unified structure.

2. The content holding apparatus of claim 1, wherein said at least one horizontal structure is selected from a group consisting of a content holder, a U-shaped content holder, a paddle-shaped content holder, and combinations thereof.

3. The content holding apparatus of claim 1, wherein said at least one horizontal structure has at least one opening for the passage of one of air and liquid.

4. The content holding apparatus of claim 1, wherein said at least one horizontal structure is secured to said outer surface of said at least one standoff using at least one arm.

5. The content holding apparatus of claim 1, wherein the cross-sectional shape of said at least one standoff is selected from a group consisting of a triangle shape, a square shape, a rectangular shape, a circular shape, a semicircular shape, an oval shape, a polygonal shape, a cylindrical shape, a cylindrical shape graduating to a point, a spike shape, and combinations thereof.

6. The content holding apparatus of claim 1, wherein material for said content holding apparatus is selected from a group consisting of non-porous material, metal, aluminum, stainless steel, plastic, silicon, rubber, a composite material, a polymeric material, a composite material, wood, and combinations thereof.

7. The content holding apparatus of claim 1, wherein shape of said base is selected from a group consisting of a triangular shape, a rectangular shape, a square shape, a wedge shape, a curved shape, a circular shape, and combinations thereof.

8. The content holding apparatus of claim 1, wherein said upper surface having said downward slope has a surface shape selected from a group consisting of a flat surface, a concave surface, an undulating surface, an outwardly reclining surface, and combinations thereof.

9. The content holding apparatus of claim 1, wherein said base has a front end and a back end, and wherein said front end is smaller than said back end.

10. The content holding apparatus of claim 1, wherein said base has a front end and a back end, and wherein said front end has a curvature.

11. The content holding apparatus of claim 1, wherein said base has a front end and a back end, and wherein said front end has a curvature, and wherein said curvature is selected from a group consisting of a concave curvature, a convex curvature, and combinations thereof.

12. The content holding apparatus of claim 1, wherein said base has at least one retaining wall on said upper surface.

13. The content holding apparatus of claim 1, wherein said at least one content is selected from a group consisting of pad, steel wool, steel wool pad, cleaning pad, bar soap, sponge, and combinations thereof.

* * * * *